US006948614B1

(12) United States Patent
Hall et al.

(10) Patent No.: US 6,948,614 B1
(45) Date of Patent: Sep. 27, 2005

(54) AUTOMOBILE REMOTE PROTECTOR

(76) Inventors: Ida M. Hall, 1452 W. 82nd St., Apt. #2, Los Angeles, CA (US) 90047; Willard Hall, 1452 W. 82nd St., Apt. #2, Los Angeles, CA (US) 90047

( * ) Notice: Subject to any disclaimer, the term of this patent is extended or adjusted under 35 U.S.C. 154(b) by 0 days.

(21) Appl. No.: 10/703,730

(22) Filed: Nov. 7, 2003

Related U.S. Application Data

(60) Provisional application No. 60/425,079, filed on Nov. 8, 2002.

(51) Int. Cl.[7] ..... B65D 85/38; A45C 11/32

(52) U.S. Cl. ..... 206/305; 150/154; 206/38.1; 206/320

(58) Field of Search ..... 206/305, 320, 206/37–37.1, 38–38.1; 70/456 R; 150/154, 150/161, 165; D3/208; 340/825.69, 825.71

(56) References Cited

U.S. PATENT DOCUMENTS

| | | | | | |
|---|---|---|---|---|---|
| 4,141,401 | A * | 2/1979 | Hindemit | 206/320 |
| 4,420,078 | A * | 12/1983 | Belt et al. | 206/305 |
| 4,733,776 | A | 3/1988 | Ward | |
| 4,762,227 | A * | 8/1988 | Patterson | 206/320 |
| 4,951,817 | A | 8/1990 | Barletta et al. | |
| 5,388,691 | A | 2/1995 | White | |
| 5,873,456 | A * | 2/1999 | Hull et al. | 206/38.1 |
| 6,155,416 | A * | 12/2000 | Jaime | 206/305 |
| D456,600 | S | 5/2002 | Gadson | |
| 6,471,056 | B1 * | 10/2002 | Tzeng | 206/320 |
| 6,533,111 | B1 * | 3/2003 | Harden | 206/38.1 |
| 6,612,432 | B2 * | 9/2003 | Motson | 206/305 |
| 2001/0002003 | A1 * | 5/2001 | Kuzdak et al. | 206/38.1 |

* cited by examiner

*Primary Examiner*—Bryon P. Gehman
(74) *Attorney, Agent, or Firm*—Kenneth L Tolar

(57) ABSTRACT

A protector for a remote keyless entry device includes a hollow enclosure constructed with a flexible, resilient but pliable material such as rubber allowing the device to tightly encapsulate varying size keyless entry devices. The enclosure includes four edges, a top surface and a bottom surface. An opening is disposed on one of the edges and is in communication with an interior chamber that receives the keyless entry device. The opening may include an elastomeric continuous band allowing the opening to expand and contract. Alternatively, the size of the opening may be fixed and can be covered with a tab that attaches to the enclosure with hook and loop fasteners, snaps and similar means. The enclosure may include a peripheral zipper in lieu of the expandable opening allowing the enclosure to open and close in a clamshell type fashion.

2 Claims, 3 Drawing Sheets

AUTOMOBILE REMOTE PROTECTOR

CROSS REFERENCE TO RELATED APPLICATIONS

This application is entitled to the benefit of provisional application No. 60/425,079 filed on Nov. 8, 2002.

BACKGROUND OF THE INVENTION

The present invention relates to a protective cover for vehicle remote keyless entry devices.

DESCRIPTION OF THE PRIOR ART

Many vehicles are equipped with keyless entry devices for remotely locking and unlocking vehicle doors. Because such remote devices are usually attached to a key chain, they are susceptible to scratching and other external damage. Furthermore, they are often exposed to rain which can irreparably damage the remote.

A myriad of vehicle remote protectors exist in the prior art. For example, U.S. Pat. No. D456,600 issued to Gadson discloses an ornamental design for a combined remote key case and key ring.

U.S. Pat. No. 5,388,691 issued to White discloses a protective case for a remote control transmitter including a clear plastic cover panel slidably received within a container. The container includes an opening through which the transmitter's key ring passes.

U.S. Pat. No. 6,155,416 issued to Jamie discloses a remote car alarm protective device including a protective housing having a first section hingedly attached to a second section whereby the first section can be pivoted upwardly to selectively expose the transmitter buttons.

U.S. Pat. No. 4,951,817 issued to Barletta discloses a beeper slip on cover.

U.S. Pat. No. 4,733,776 issued to Ward discloses a protective device for a remote control unit including a resilient, deformable foam housing having a flexible, transparent panel overlaying the remote buttons. The remote is secured within the housing with hook and loop fasteners.

As indicated above, numerous remote protective enclosures exist in the prior art. However, each of the devices is complex and therefore expensive to manufacture; furthermore, each device requires that an access panel or an equivalent be manipulated in order to insert and remove the vehicle remote which is cumbersome and laborious.

The present invention overcomes the above described problems by providing a protector that is designed to allow a remote to be quickly and easily removed or installed. Furthermore, the device easily accommodates varying size keyless entry devices.

SUMMARY OF THE INVENTION

The present invention discloses a protector for a remote keyless entry device including a hollow enclosure having four edges, a top surface and a bottom surface. On one of the edges is an opening in communication with an interior chamber. The opening is expandable allowing varying size remote keyless entry devices to pass therethrough. The enclosure may include a transparent panel on the top surface providing access to the function buttons on the remote keyless entry device. The expandable opening may be sealed with a tab that attaches to the enclosure with hook and loop fasteners, snaps or similar fasteners. Another embodiment includes a zipper along three of the edges allowing the enclosure to open and close in a clamshell type fashion.

It is therefore an object of the present invention to provide a protector for a remote keyless entry device that protects it from external damage.

It is another object of the present invention to provide a protector that is configured to fit about varying size remote keyless entry devices.

It is yet another object of the present invention to provide a protector for a vehicle remote that can be quickly and easily secured about the remote. Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
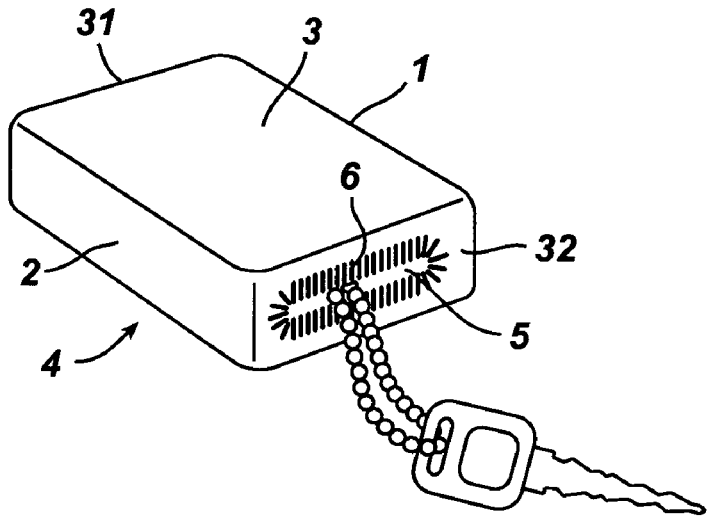
FIG. 1 depicts a first embodiment of the present invention.
Figure 2:
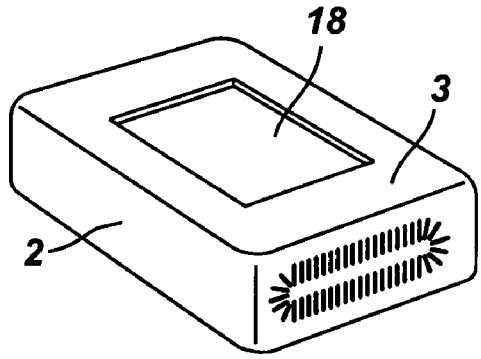
FIG. 2 depicts a slight variation of the embodiment depicted in FIG. 1.
Figure 3:
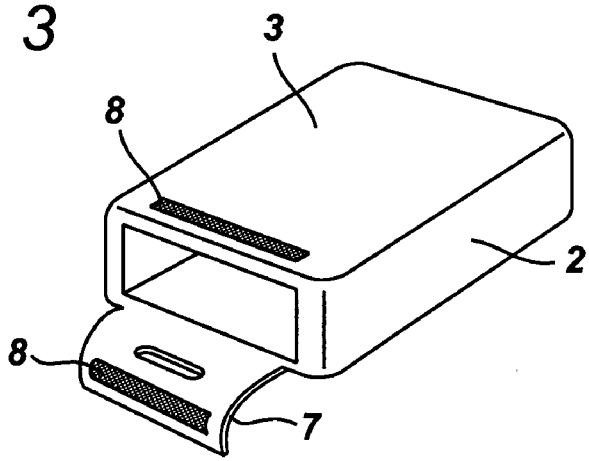
FIG. 3 depicts a slight variation of the embodiment depicted in FIGS. 1 and 2.
Figure 4:
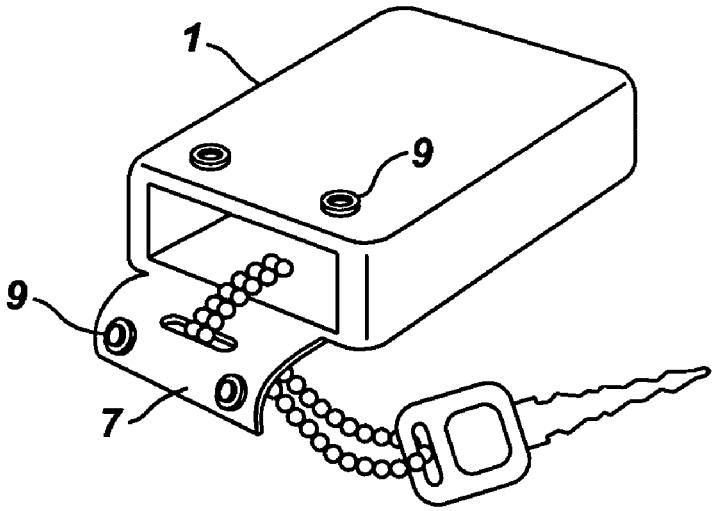
FIG. 4 depicts a different tab attachment means than that depicted in FIG. 3.

The present invention discloses a protector for a remote keyless entry device including a hollow enclosure 1 having a top edge 32, a bottom edge 31, two opposing side edges 2, a top surface 3 and a bottom surface 4. The enclosure is constructed with a pliable but resilient material such as rubber or vinyl allowing the enclosure to conform to varying size remote devices. On one of the edges is an opening 5 in communication with an interior chamber. The opening is expandable whereby varying size remote keyless entry devices may be inserted therethrough. For example, the opening may include an elastomeric band 6 integral with the seam that defines the opening allowing the opening to expand and contract.

As depicted in FIG. 1, the enclosure may include a transparent panel 18 on the top surface whereby a user can observe and manipulate the function buttons on the remote keyless entry device while the device is received within the protector. The enclosure may also include a tab 7 that overlays the opening and attaches to the enclosure with hook and loop fasteners 8, snaps 9 or similar means. In this particular embodiment, the opening may be expandable or fixed size, as desired.

Figure 5:
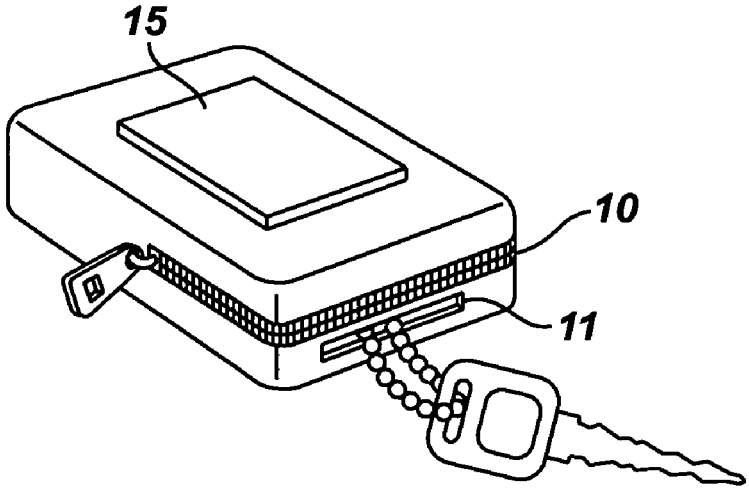
FIG. 5 depicts a second embodiment of the present invention.
Figure 6:
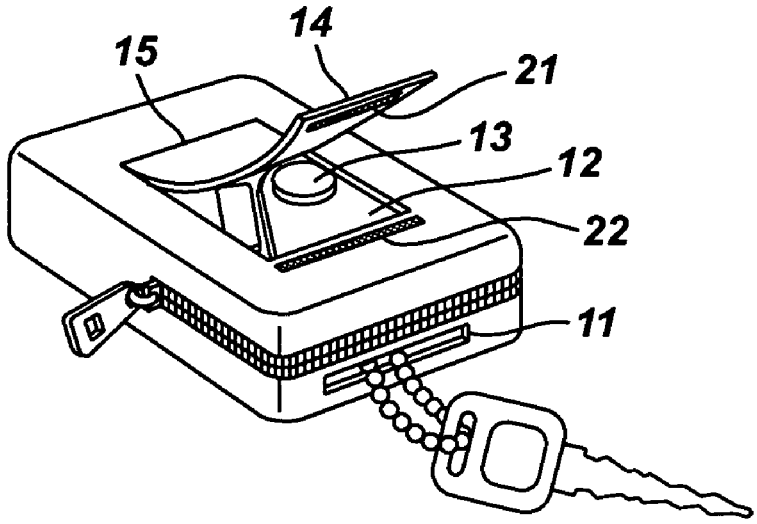
FIG. 6 depicts the second embodiment with the control button access flap in an opened position.
Figure 7:
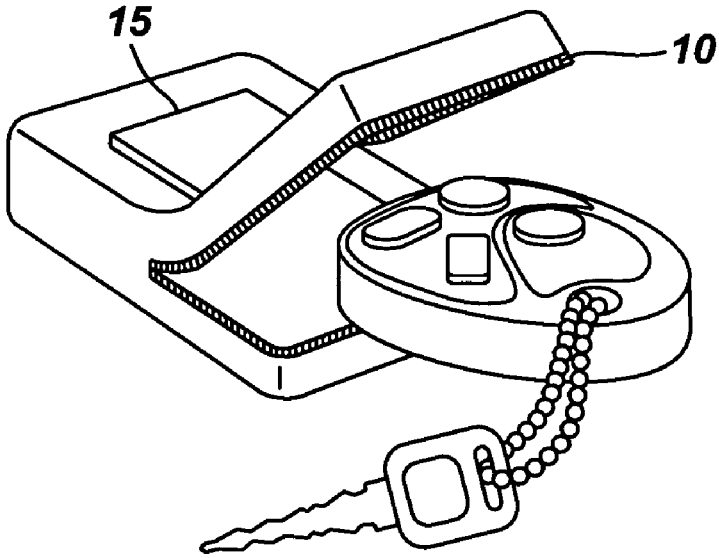
FIG. 7 depicts the second embodiment in an opened position so as to receive a vehicle remote.

Now referring to FIGS. 5–7, another embodiment is depicted that allows for quick and easy removal and installation of the vehicle remote. In this particular embodiment, the top edge and each of the two side edges include a separable seam that defines the opening for receiving the remote. The seam is selectively closed with a zipper 10. Accordingly, the enclosure can open and close in a clamshell type fashion. Preferably, the seam and corresponding zipper extend along the entire length of the top edge and a portion of each of the two side edges. A slit 11 is positioned on the top edge immediately beneath the zipper through which a key chain or ring passes, allowing the enclosure to be completely sealed about the remote without enclosing the keys.

On the top surface of the enclosure is a window 12 that is superimposed on the control buttons 13 when the remote is received within the enclosure. The window is selectively covered with a flap 14 that can be raised to provide selective access to the control buttons. The flap includes a lower edge 15 fixedly attached to the top surface of the enclosure. Adjacent an opposing upper edge is a hook and loop fastener 21 that engages a mating fastener 22 on the enclosure to removably attach the flap thereto. Accordingly, the remote control buttons can be easily accessed without removing the remote from the enclosure.

The above described device can be constructed with any variety of materials such as foam rubber, leather, vinyl or any other suitable equivalent. The zipper is preferably constructed with plastic or a similar material so as to be corrosion resistant. Furthermore, though the device is depicted and described as being primarily rectangular or square in shape, the device can have any shape depending upon the shape of a given remote. However, as will be readily apparent to those skilled in the art, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A protective cover for a vehicle remote comprising:

a hollow enclosure having a top surface, a bottom surface, a top edge, two opposing side edges and a hollow interior, said hollow interior dimensioned and configured to receive a vehicle remote; said enclosure constructed with a pliable but resilient material allowing said enclosure to receive varying sized vehicle remotes;

a separable seam extending along a portion of one of said side edges, along an entire portion of said top edge and along a portion of another of said side edges, said seam including a zipper extending along an entire length thereof for separating and joining said seam allowing said enclosure to open and close in a clamshell type fashion;

a window on the top surface of said enclosure, said window positioned to overlay control buttons on a received remote;

a first fastener on said top surface adjacent said window;

a flap superimposed on said window, said flap having a free edge with a second fastener adjacent the free edge, said second fastener engaging said first fastener adjacent said window whereby when said fasteners are disengaged said flap is raised to selectively expose control buttons on a received remote.

2. The protective cover for a vehicle remote according to claim 1 further comprising a slit positioned on the top edge of said enclosure and adjacent said seam allowing a key associated with received remote to pass through said enclosure when said enclosure is sealed about a remote.

* * * * *